US009685743B2

(12) United States Patent
Ma et al.

(10) Patent No.: US 9,685,743 B2
(45) Date of Patent: Jun. 20, 2017

(54) ELECTRICAL CONNECTOR HAVING A LIGHT GUIDE AND A LIGHT SOURCE CARRYING INTERNAL PRINTED CIRCUIT BOARD

(71) Applicant: FOXCONN INTERCONNECT TECHNOLOGY LIMITED, Grand Cayman, KY (US)

(72) Inventors: Guang-Yu Ma, Kunshan (CN); Dou-Feng Wu, Kunshan (CN); Xiao-Li Li, Kunshan (CN); Jian Li, Kunshan (CN); Chien-Hsun Huang, New Taipei (TW)

(73) Assignee: FOXCONN INTERNCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/235,436

(22) Filed: Aug. 12, 2016

(65) Prior Publication Data

US 2017/0047695 A1 Feb. 16, 2017

(30) Foreign Application Priority Data

Aug. 12, 2015 (CN) ..... 2015 1 0488801

(51) Int. Cl.

| | |
|---|---|
| ***H01R 13/66*** | (2006.01) |
| ***H01R 13/717*** | (2006.01) |
| ***H01R 13/631*** | (2006.01) |
| ***H01R 24/62*** | (2011.01) |
| *H01R 107/00* | (2006.01) |

(52) U.S. Cl.

CPC ..... *H01R 13/717* (2013.01); *H01R 13/631* (2013.01); *H01R 24/62* (2013.01); *H01R 2107/00* (2013.01)

(58) Field of Classification Search

CPC .. H01R 13/717; H01R 13/175; H01R 13/562; H01R 13/6658; H01R 12/53; H01R 24/62; H01R 13/631; H01R 2107/00; G02B 6/3878

USPC ..... 439/620.22

See application file for complete search history.

(56) References Cited

U.S. PATENT DOCUMENTS

| | | | |
|---|---|---|---|
| 6,165,006 | A | 12/2000 | Yeh et al. |
| 6,336,825 | B1 | 1/2002 | Seefried |
| 7,004,595 | B1 | 2/2006 | Stoddard |
| 7,393,237 | B2 | 7/2008 | Kuo |

(Continued)

FOREIGN PATENT DOCUMENTS

| | | |
|---|---|---|
| CN | 201252264 | 6/2009 |
| TW | M496870 | 3/2015 |

*Primary Examiner* — Jean F Duverne

(74) *Attorney, Agent, or Firm* — Wei Te Chung; Ming Chieh Chang

(57) ABSTRACT

A cable-end electrical connector includes a frontal mating member; a vertical internal printed circuit board defining a front surface; a number of light sources positioned on the front surface of the printed circuit board; a light transmissive member permitting a light emitted from the light source to pass through; and a cover enclosing the light transmissive member and the printed circuit board. The light transmissive member includes a penetrable portion permitting the light to pass through and a holding section holding the printed circuit board and constraining the printed circuit board from moving in an up-and-down direction.

14 Claims, 7 Drawing Sheets

(56) References Cited

U.S. PATENT DOCUMENTS

| | | | | |
|---|---|---|---|---|
| 7,661,983 | B2 * | 2/2010 | Yang | H01R 4/02 439/490 |
| 7,744,231 | B2 | 6/2010 | Hutchinson et al. | |
| 7,758,373 | B2 * | 7/2010 | Zhou | H01R 13/562 439/455 |
| 7,976,336 | B2 * | 7/2011 | Yang | H01R 13/6658 439/490 |
| 8,124,496 | B2 * | 2/2012 | Su | H01R 13/7175 438/449 |
| 8,608,520 | B2 * | 12/2013 | Yuan | H01R 12/53 439/886 |
| 8,731,405 | B2 * | 5/2014 | Renfro, Jr. | G02B 6/3878 398/117 |
| 9,022,605 | B2 | 5/2015 | Bushnell et al. | |
| 9,461,417 | B2 * | 10/2016 | Zhang | H01R 13/7175 |
| 2003/0100218 | A1 | 5/2003 | Tsai et al. | |
| 2003/0194906 | A1 | 10/2003 | Arkin et al. | |
| 2006/0039136 | A1 | 2/2006 | Probasco et al. | |
| 2006/0099999 | A1 | 5/2006 | Park | |
| 2008/0003867 | A1 | 1/2008 | Wu | |
| 2016/0118755 | A1 | 4/2016 | Chen et al. | |

* cited by examiner

ELECTRICAL CONNECTOR HAVING A LIGHT GUIDE AND A LIGHT SOURCE CARRYING INTERNAL PRINTED CIRCUIT BOARD

BACKGROUND OF THE INVENTION

1. Field of the Invention

The present invention relates generally to an electrically connector, and more particularly to an electrical connector having a light source and an internal printed circuit board carrying the light source.

2. Description of Related Arts

U.S. Patent Application Publication No. 2013/0065444, published on Mar. 14, 2013, discloses a charging connection device comprising: a device connector; an internal printed circuit board coupled to the connector and including charging circuitry and an associated light source; a housing enclosing the circuit board and including a first end comprising a light guide or lens, the connector extending from the first end; a touch-type switch carried by the housing, coupled to the circuit board and configured to activate the light source; and a power source connector coupled to the circuit board and associated with a second end of the housing. The circuit board is horizontally oriented.

An electrical connector having an improved printed circuit board is desired.

SUMMARY OF THE INVENTION

An object of the present invention is to provide an electrical connector having an improved printed circuit board.

To achieve the above-mentioned object, a cable-end electrical connector includes: a frontal mating member; a vertical internal printed circuit board defining a front surface; a number of light sources positioned on the front surface of the printed circuit board; a light transmissive member permitting a light emitted from the light source to pass through; and a cover enclosing the light transmissive member and the printed circuit board. The light transmissive member includes a penetrable portion permitting the light to pass through and a holding section holding the printed circuit board and constraining the printed circuit board from moving in an up-and-down direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
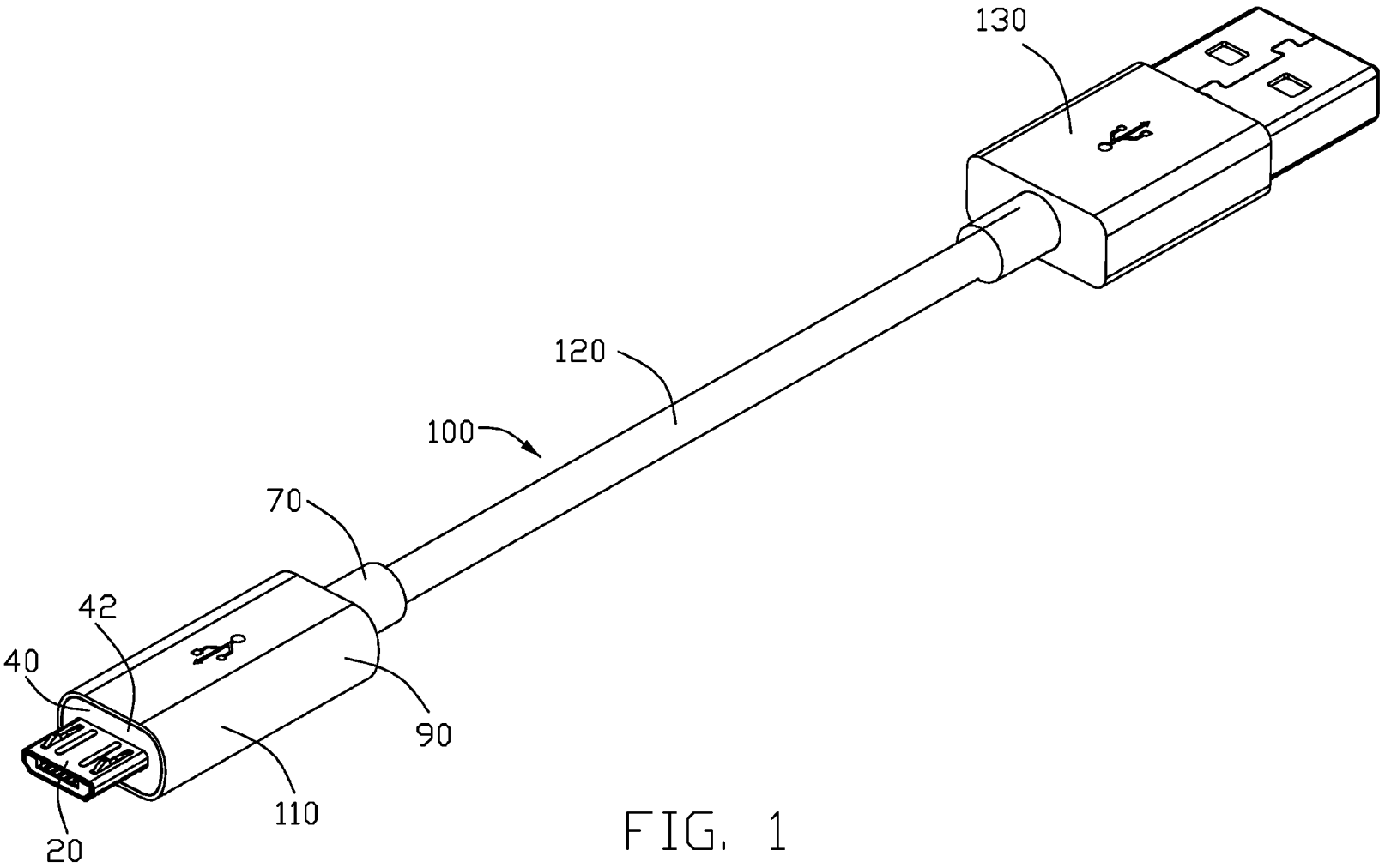
FIG. 1 is a perspective, assembled view of a cable connector assembly in accordance with the present invention.
Figure 2:
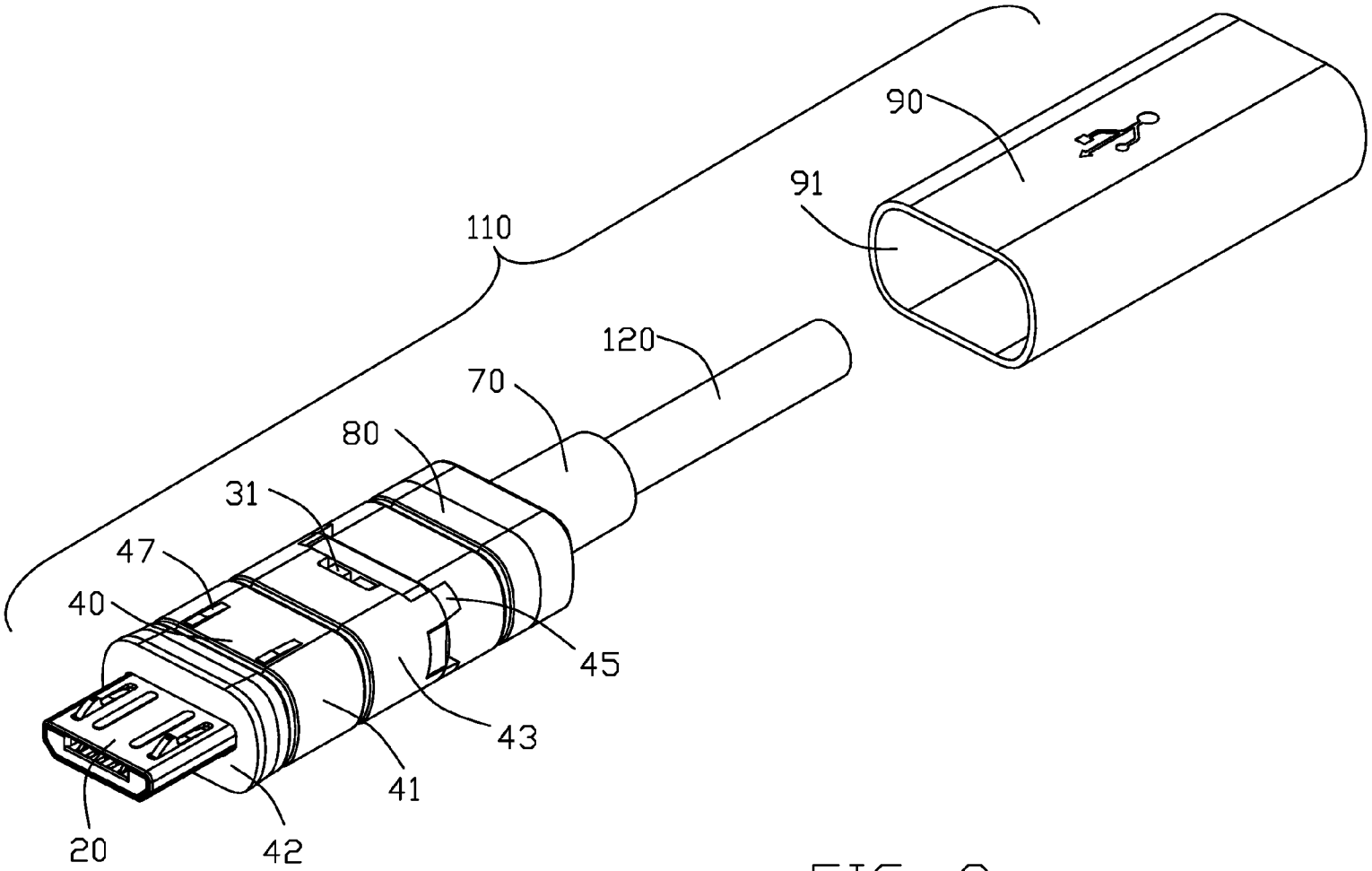
FIG. 2 is a perspective, partially exploded view of the cable connector assembly shown in FIG. 1.
Figure 3:
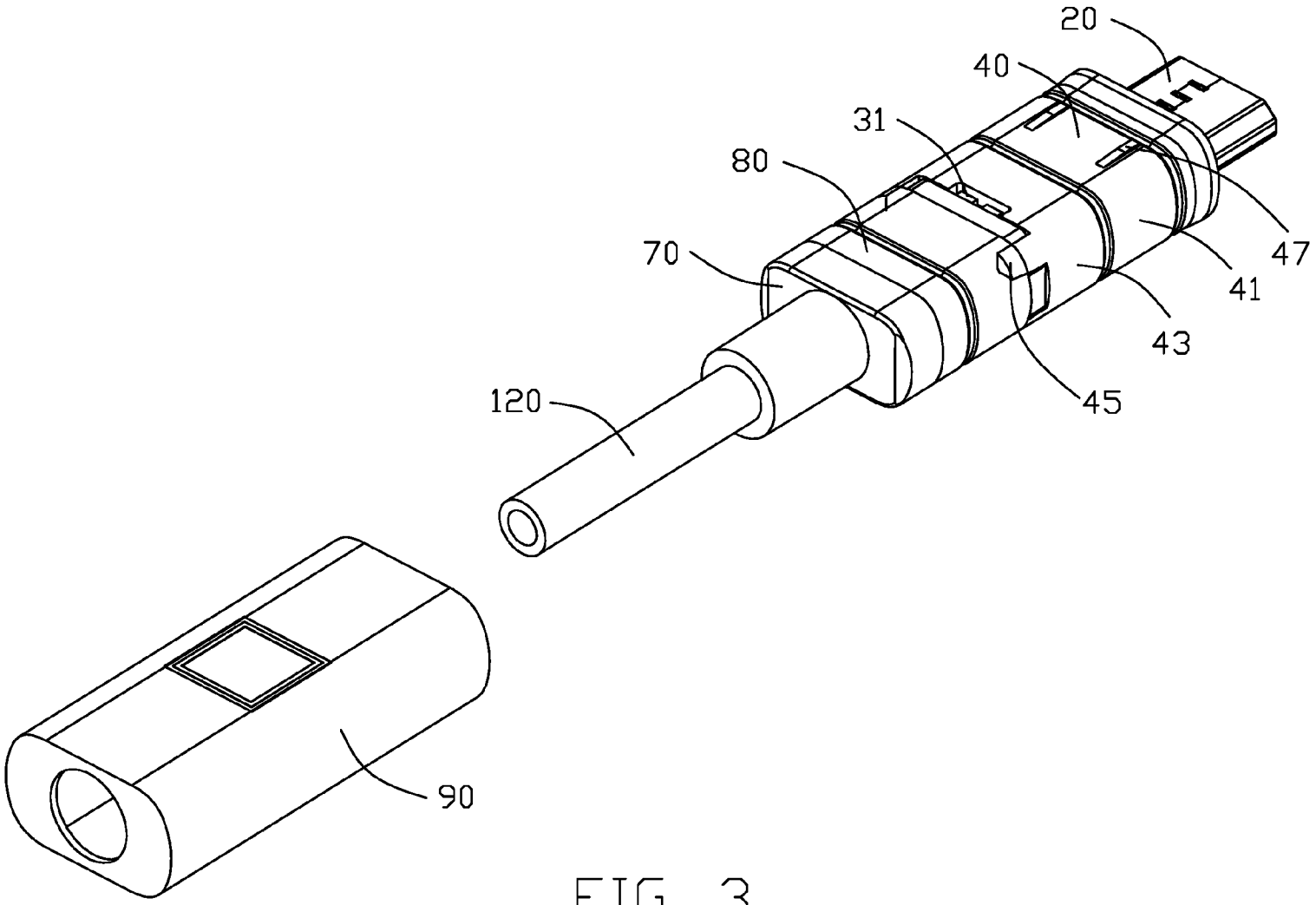
FIG. 3 is a view similar to FIG. 2, but viewed from another aspect.
Figure 4:
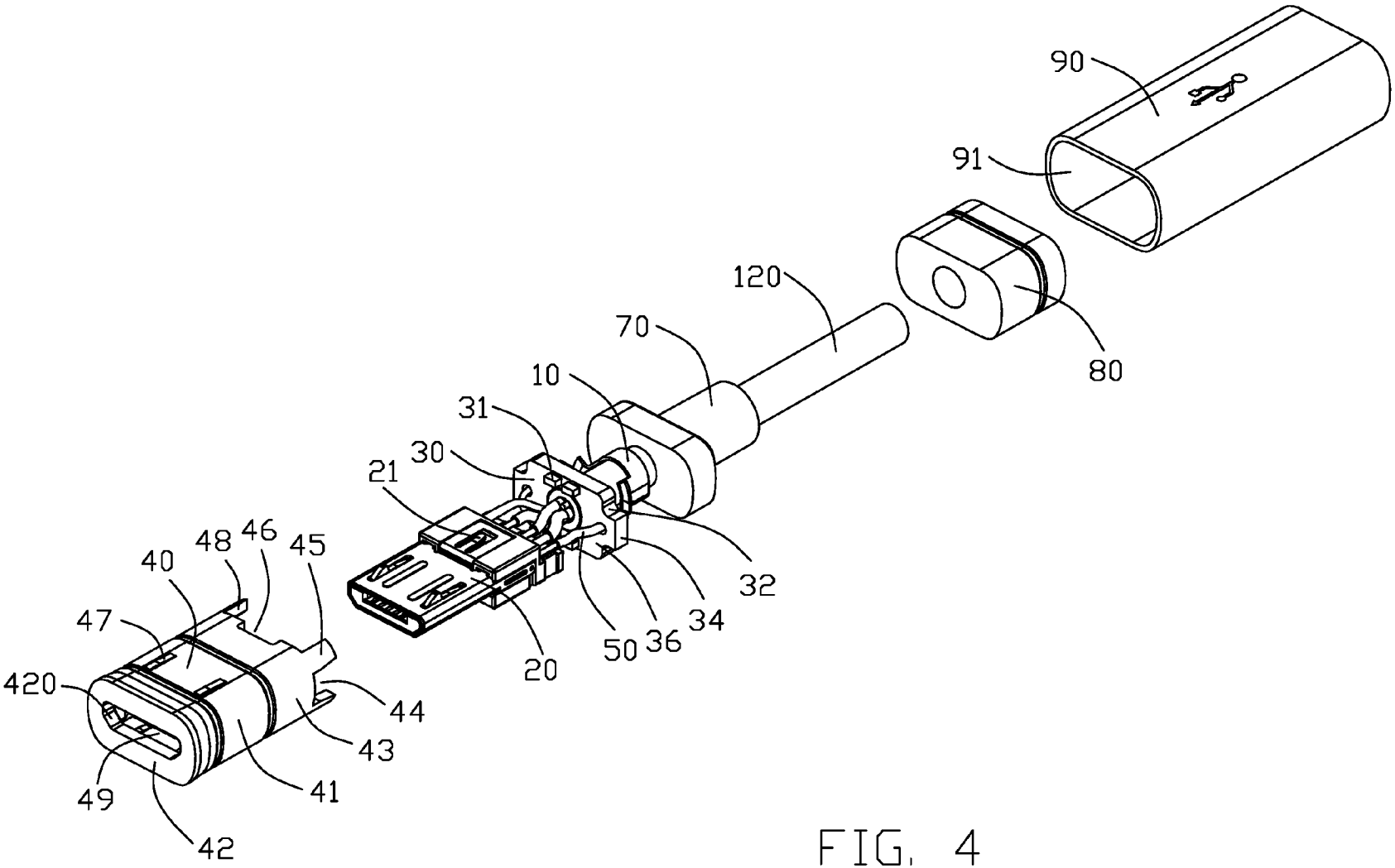
FIG. 4 is a further partially exploded view of the cable connector assembly shown in FIG. 2.
Figure 5:
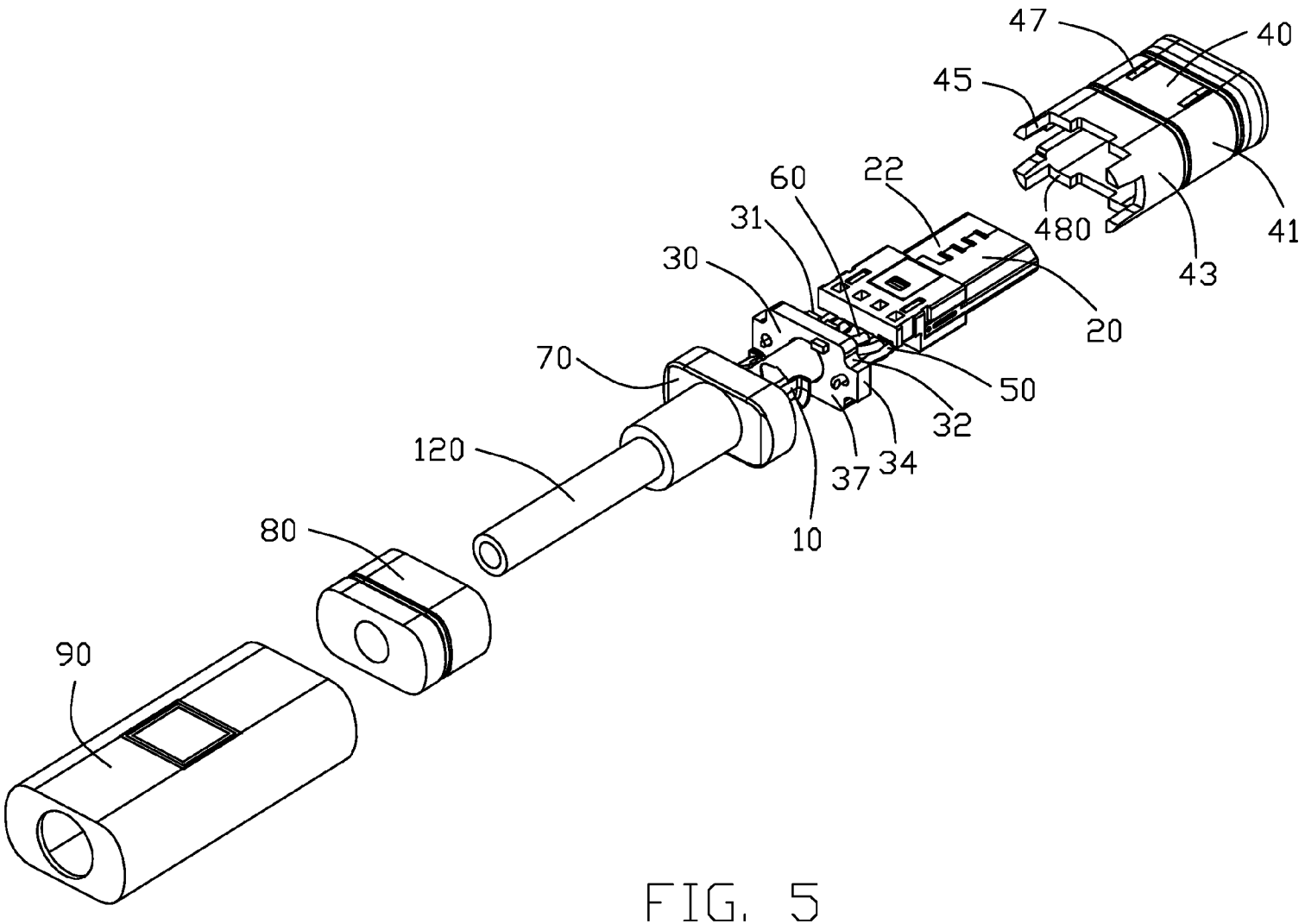
FIG. 5 is a view similar to FIG. 4, but viewed from another aspect.

Referring to FIG. 1, the cable connector assembly 100 in accordance with the present invention comprises an electrical connector 110, a cable 120 connected with the electrical connector 110 and a USB connector 130 connected with the cable 120.

Referring to FIGS. 1-7, the electrical connector 110 comprises a frontal mating member 20 connected with the cable 120 electrically, a vertical printed circuit board connected with the mating electrically, a plurality of light sources 31 positioned on the printed circuit board 30, a shielding ring 10 attached to the cable 120, a light transmissive member 40 permitting a light emitted from the light source 31 to pass through, an inner insulator 80 covering a front end of the cable 120 and a rear end of printed circuit board 30, and a cover 90 defining a space 91 for enclosing the light transmissive member 40 and the inner insulator 10.

As shown in FIGS. 4-7, the mating member 20 comprises an insulative housing 23, a plurality of contacts 24 and a shielding shell 22 enclosing the insulative housing 23. The shielding shell 22 comprises a resisting section 21 resisting against the light transmissive member 40.

As shown in FIGS. 4-7, the printed circuit board 30 comprises a front surface 36, a rear surface 37, a main hole 35 permitting the cable 120 to pass through, a plurality of through holes 33 passing through the front surface 36 and the rear surface 37, a plurality of slots 32 and a plurality of convex parts 34. The printed circuit board 30 is positioned in the vertical direction. In the embodiment of the present invention, there are two light sources 31 positioned on two sides of the front surface 36 symmetrically in an up-and-down direction. There are two through holes 33 positioned on two sides of the front surface 36 in a left-and-right direction perpendicular to the up-and-down direction. The main hole 35 is located in the middle of the printed circuit board 30 and surrounded by the two light sources 31 and the two through holes 33. There are four slots 32 formed in the four angles of the printed circuit board 30. There are four convex parts 34 formed between two neighboring slots 32. In another embodiment of the present invention, the light sources 31 are positioned on two sides of the front surface 36 symmetrically in the left-and-right direction. The through holes 33 are positioned in two sides of the front surface 36 symmetrically in the up-and-down direction. In another embodiment of the present invention, the light sources 31 can also be positioned on four sides of the front surface 36.

The light transmissive member 40 comprises a penetrable portion 42 through which the light penetrates, a positioning portion 41 extending rearwardly from the penetrable portion 42 and a receiving space 49 surrounded by the penetrable section 42 and the positioning portion 41. The penetrable portion 42 is located in a front end of the light transmissive member 40 and exposed out of a front end of the cover 90. The penetrable portion 42 defines an opening 420 through which the mating member 20 passes. The opening 420 is connected with the receiving space 49. The positioning portion 41 comprises four walls 43 surrounding the receiving space 49, a settled section 47 fixed to the cover 90 and a holding section 48 holding the printed circuit board 30. The holding section 48 comprises a plurality of clamping arms 45 coordinated with the slots 32, a plurality of troughs 44 coordinated with the convex parts 36, a notch 46 receiving a part of the light source 31 and a receiving cavity 480 receiving the printed circuit board 30. The receiving cavity 480 is surrounded by the clamping arms 45, the troughs 44 and the notch 46. The periphery of the cross-section of the receiving cavity 480 is the same as the periphery of the cross-section of the printed circuit board 30. The height of the light transmissive member 40 in the up-and-down direction is the same as the height of the printed circuit board 30 in the up-and-down direction. The length of the clamping arms 45 in a front-and-rear direction is bigger than the thickness of the printed circuit board 30 in the front-and-rear direction. The inner insulator 80 is molded to the front end of the cable 120, the rear end of the printed circuit board 30 and a part of the clamping arms 45 extended out of the printed circuit board 30. The notch 46 is connected with the receiving space 49 and the receiving cavity 480, the light source 31 is received in the notch 46 and the receiving space 49, and the light penetrates through the receiving space 49 and the penetrable portion 42. The clamping arms 45 are extended rearwardly from four angles of a rear end of the four walls 43. The troughs 44 are formed between two neighboring clamping arms 45.

Figure 6:
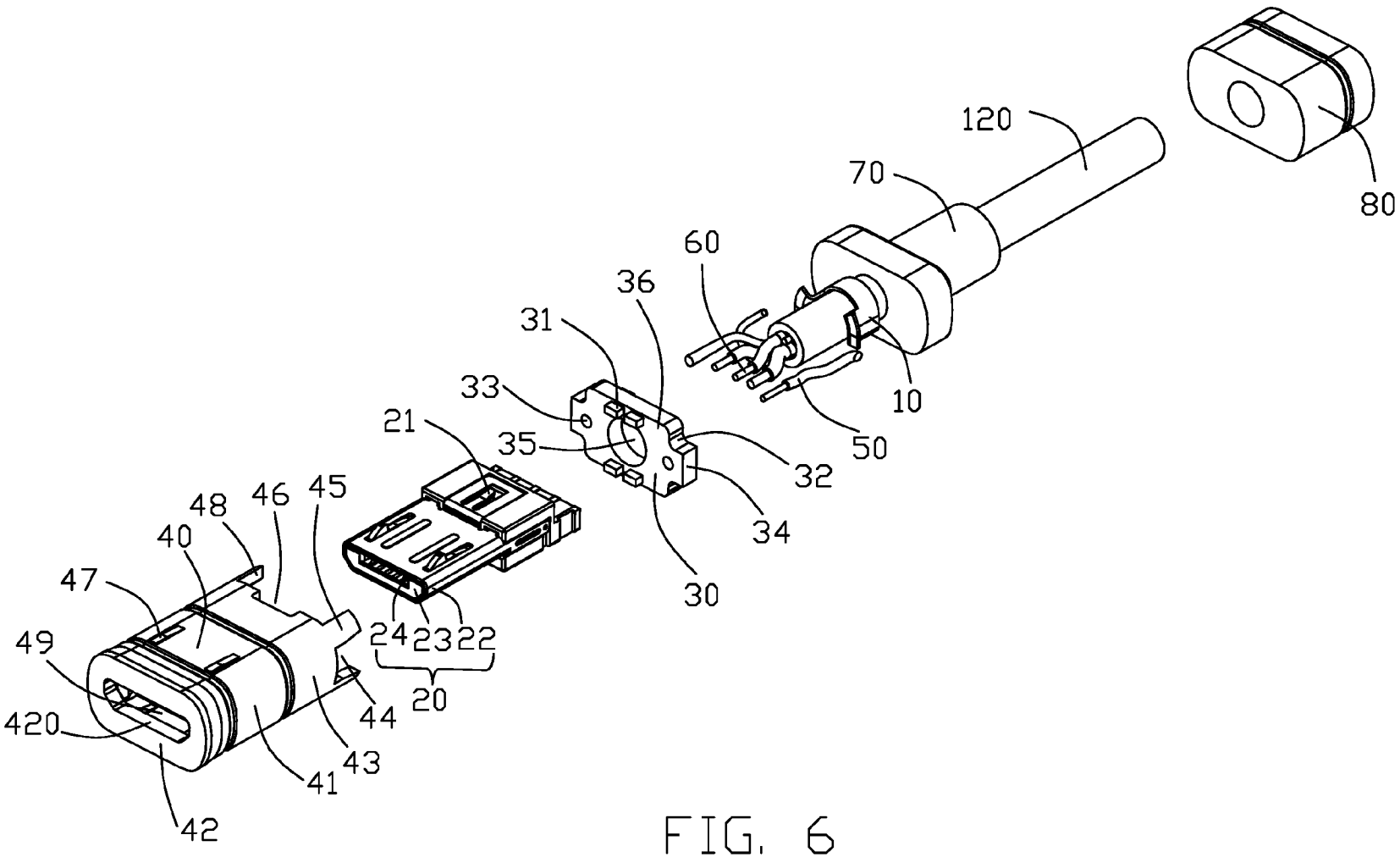
FIG. 6 is a perspective, exploded view of the cable connector assembly shown in FIG. 1.
Figure 7:
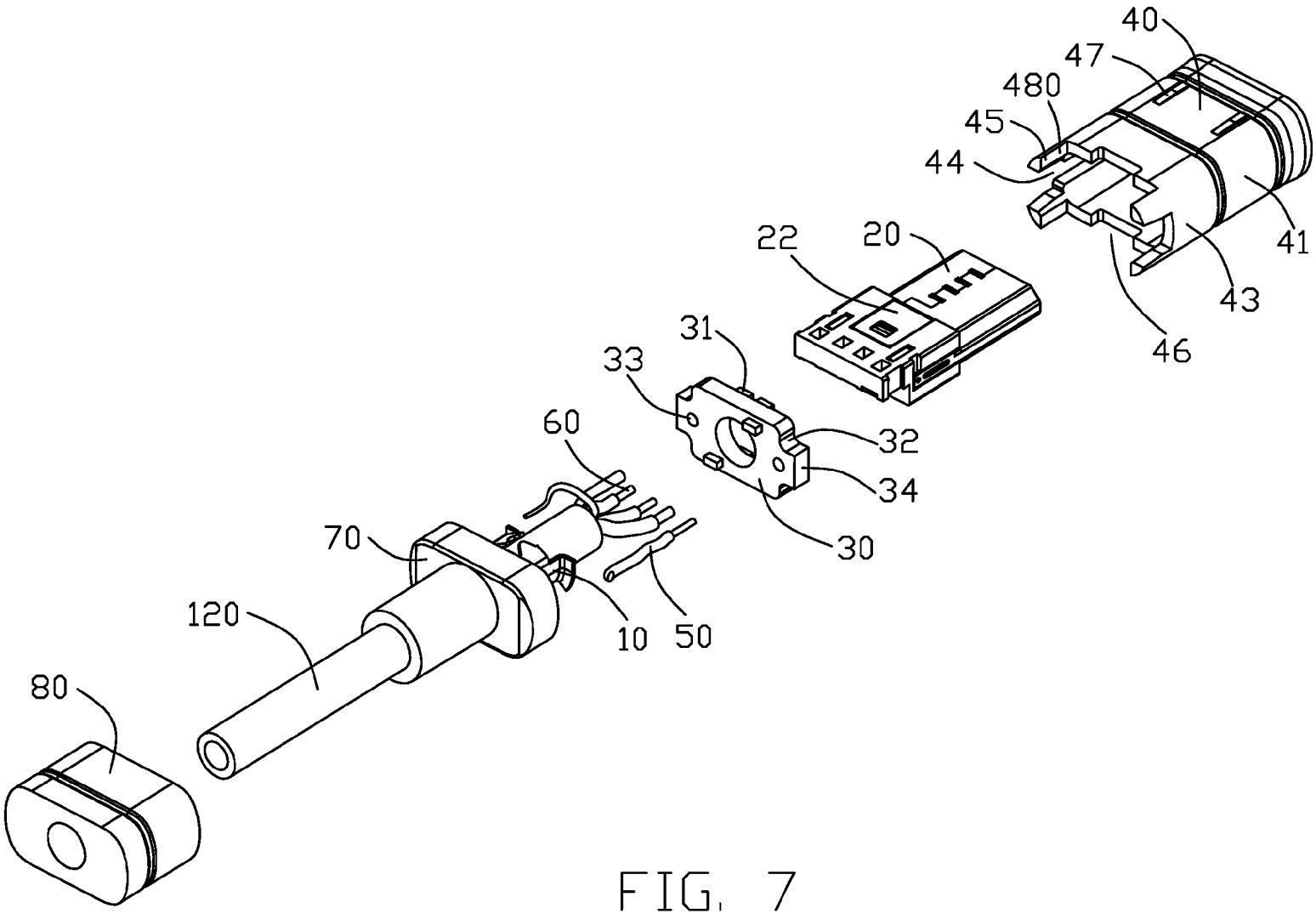
FIG. 7 is a view similar to FIG. 6, but viewed from another aspect.

As shown in FIGS. 6-7, the cable 120 comprises a strain relief 70, a plurality of main wires 60 and a plurality of jumper wires 50. The cable 120 is connected with the printed circuit board 30 and the contacts 24 electrically. The mating member 20 is connected with the printed circuit board 30 through the jumper wires 50 electrically.

In assembly, a shielding ring 10 is attached to the cable 120, the main wires 60 are connected with the mating member 20 electrically through passing through the main hole 35, the jumper wires 50 are connected with the mating member 20 and the printed circuit board 30 electrically, the inner insulator 80 is molded to the front end of the cable and the rear end of the printed circuit board 30 by over-molding process, the light transmissive member 40 is assembled to the mating member 20, the mating member 20 passes through the opening 420, and at last the cover 90 is attached to the inner insulator 80 and the light transmissive member 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable-end electrical connector comprising:

a frontal mating member;

a vertical internal printed circuit board electrically connected with the mating member, the printed circuit board defining a front surface;

a plurality of light sources positioned on the front surface of the printed circuit board;

a light transmissive member permitting a light emitted from the light source to pass through, the light transmissive member comprising a penetrable portion permitting the light to pass through and a holding section holding the printed circuit board and constraining the printed circuit board from moving in an up-and-down direction; and a cover enclosing the light transmissive member and the printed circuit board; wherein the printed circuit board comprises a plurality of slots and a plurality of convex parts located in a periphery thereof, and the holding section comprises a plurality of clamping arms corresponding to the slots and a plurality of troughs corresponding to the convex parts; wherein a length of the clamping arm in a front-and-rear direction is greater than a thickness of the printed circuit board in the front-and-rear direction.

2. The electrical connector as claimed in claim 1, wherein the holding section has a receiving cavity receiving the printed circuit board, and a cross-section of the receiving cavity conforms to a cross-section of the printed circuit board.

3. The electrical connector as claimed in claim 1, wherein an exterior surface of the printed circuit board is aligned with an exterior surface of the holding section.

4. The electrical connector as claimed in claim 1, wherein the holding section comprises a notch extending from a corresponding trough to receive a part of the light source.

5. The electrical connector as claimed in claim 1, further comprising a cable including a plurality of main wires and a plurality of jumper wires, and wherein the mating member and the printed circuit board are connected electrically through the jumper wires, and the printed circuit board comprises a main hole permitting the main wires to pass through and a plurality of through holes permitting the jumper wires to pass through.

6. The electrical connector as claimed in claim 5, wherein the light sources are located beside the main hole, and the through holes are located beside the main hole.

7. The electrical connector as claimed in claim 6, wherein the light sources are positioned on two sides of the main hole symmetrically in the up-and-down direction, and the through holes are positioned on two sides of the main hole symmetrically in a left-and-right direction.

8. A cable-end electrical connector comprising:

a frontal mating member;

a vertical printed circuit board connected with the mating member electrically, the printed circuit board defining a front surface;

a pair of light sources positioned on two sides of the front surface of the printed circuit board;

a light transmissive member permitting a light emitted from the light source to pass through, the light transmissive member defining a receiving space receiving the mating member; and a cover enclosing the light transmissive member and the printed circuit board; wherein the light transmissive member comprising a penetrable portion permitting the light to pass through and a holding section holding the printed circuit board for constraining the printed circuit board from moving in an up-and-down direction; wherein the printed circuit board comprises a plurality of slots and a plurality of convex parts located in the periphery thereof, the holding section comprises a plurality of clamping arms coordinated with the slots and a plurality of troughs coordinated with the convex parts, and the external surface of the printed circuit board is aligned with the external surface of the holding section.

9. The electrical connector as claimed in claim 8, wherein the light transmissive member comprises a receiving cavity receiving the printed circuit board, the receiving cavity being in communication with the receiving space.

10. The electrical connector as claimed in claim 9, wherein the light transmissive member comprises a notch extending from the receiving cavity to receive a part of the light source.

11. The electrical connector as claimed in claim 9, wherein the periphery of the cross-section of the receiving cavity is the same as the periphery of the cross-section of the printed circuit board.

12. The electrical connector as claimed in claim 8, wherein the light sources are positioned symmetrically on two sides of the front surface in an up-and-down direction.

13. An electrical connector assembly comprising:

a front mating member including a plurality of contacts and forwardly communicating with an exterior along a front-to-back direction;

a printed circuit board extending in a vertical plane perpendicular to said front-to-back direction and electrically connected to the mating member, said printed circuit board defining a forwardly facing front surface in said front-to-back direction;

at least one light source positioned on the front surface of the printed circuit board and essentially located around a peripheral region of said front surface;

a light transmissive member permitting a light to penetrate therethrough, and defining a tubular structure which the mating member extends through and is received in, said light transmissive member defining an exposing portion around a front face thereof to forwardly communicate with the exterior in said front-to-back direction; wherein the light source is aligned with a specific position of the light transmissive member along said front-to-back direction so as to have corresponding light generated by said light source directly forwardly penetrate the light transmissive member and further forwardly emit around the exposing portion along only said front-to-back direction; wherein said light transmissive member further includes a holding section holding the printed circuit board and constraining the printed circuit board from moving in said vertical plane; wherein said holding section extends rearwardly beyond said printed circuit board in said front-to-back direction.

14. The electrical cable connector assembly as claimed in claim 13, further including a cable equipped with a plurality of wires extending through the printed circuit board and mechanically and electrically connected to the corresponding contacts, respectively.

* * * * *